US008567993B2

(12) United States Patent
ten Wolde

(10) Patent No.: US 8,567,993 B2
(45) Date of Patent: Oct. 29, 2013

(54) EMERGENCY ILLUMINATION DEVICE AND METHOD OF OPERATING AN EMERGENCY ILLUMINATION DEVICE

(75) Inventor: Michael Robert ten Wolde, Den Haag (NL)

(73) Assignee: Nodazzle Holding BV, Den Haag (NL)

( * ) Notice: Subject to any disclaimer, the term of this patent is extended or adjusted under 35 U.S.C. 154(b) by 253 days.

(21) Appl. No.: 13/132,933

(22) PCT Filed: Dec. 4, 2009

(86) PCT No.: PCT/NL2009/050739

§ 371 (c)(1),
(2), (4) Date: Aug. 22, 2011

(87) PCT Pub. No.: WO2010/064915

PCT Pub. Date: Jun. 10, 2010

(65) Prior Publication Data

US 2011/0292645 A1 Dec. 1, 2011

(30) Foreign Application Priority Data

Dec. 5, 2008 (NL) ..... 2002293

(51) Int. Cl.
*F21V 23/04* (2006.01)
*F21V 21/00* (2006.01)

(52) U.S. Cl.
USPC ..... 362/276; 362/253; 362/217.1; 362/802

(58) Field of Classification Search
USPC ..... 362/217.1, 253, 276, 802
See application file for complete search history.

(56) References Cited

U.S. PATENT DOCUMENTS

| | | | | |
|---|---|---|---|---|
| 5,015,994 | A | 5/1991 | Hoberman et al. | |
| 6,196,703 | B1 * | 3/2001 | Eusterbrock et al. | 362/276 |
| 7,070,299 | B2 * | 7/2006 | Williams et al. | 362/231 |
| 8,398,257 | B1 * | 3/2013 | Paulus | 362/183 |
| 2004/0184273 | A1 | 9/2004 | Reynolds et al. | |
| 2008/0204258 | A1 | 8/2008 | Dayton et al. | |

FOREIGN PATENT DOCUMENTS

| | | | |
|---|---|---|---|
| NL | 1 009 242 | C2 | 11/1999 |
| WO | 2008/061870 | A1 | 5/2008 |

OTHER PUBLICATIONS

International Search Report, dated Mar. 26, 2010, from corresponding PCT application.

* cited by examiner

*Primary Examiner* — Stephen F Husar
*Assistant Examiner* — James Cranson, Jr.
(74) *Attorney, Agent, or Firm* — Young & Thompson

(57) ABSTRACT

An emergency illumination device includes a housing. The emergency illumination device is arranged to include a light source and a power supply. The emergency illumination device further includes a motion detector to generate a motion signal when motion is detected. The emergency illumination device is arranged to switch on the light source when a motion signal is generated by the motion detector. The housing includes a first outer surface arranged to support the emergency illumination device when positioned on a bearing surface. The motion detector generates a motion detection plane that is substantially perpendicular with respect to the first outer surface.

19 Claims, 4 Drawing Sheets

Figure 1A:
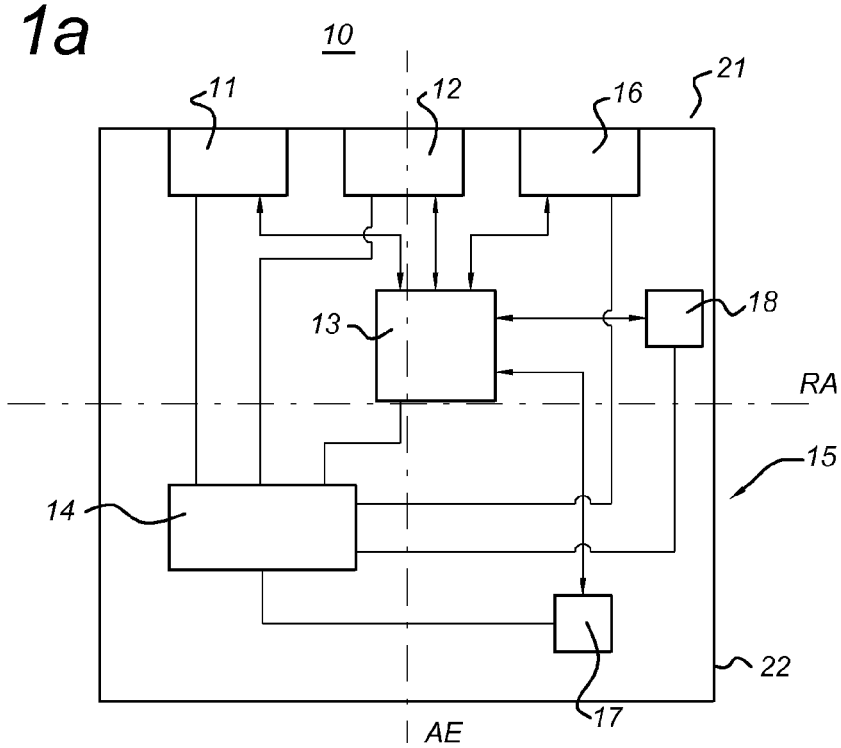

EMERGENCY ILLUMINATION DEVICE AND METHOD OF OPERATING AN EMERGENCY ILLUMINATION DEVICE

TECHNICAL FIELD

The invention relates to an emergency illumination device, a method for operating an emergency illumination device, a computer program, and a computer readable medium, comprising such a computer program.

STATE OF THE ART

Portable emergency illumination devices, such as electrical torches (also known as pocket torches or flashlights), are well known. Such portable emergency illumination devices may be used in many different situations, for instance:

in case of a fire, in case of a power failure, for instance due to a fire, at an unknown location, for instance a hotel room, at a location where there is no other light source available, for instance in a cellar.

The term emergency illumination device may be used to refer to lightning provided for use when the supply to the normal mains lightning installation fails.

When a user wants to use his/her portable emergency illumination device, the first problem he/she is faced with is to locate the emergency illumination device, which is not always very easy in a stressful emergency situation and/or a situation without sufficient light. This problem may be solved by using a motion detector which switches on the emergency illumination device when motion is detected.

An illumination device is known from NL1009242. According to NL1009242, a movement sensor is provided and when the movement sensor detects movement and when the light intensity of the surrounding area is below a predetermined limit, a signal is generated so that an electronic switch which is provided between a terminal and a LED is closed for a predetermined time, switching on the light. The closing time of the electronic switch and light intensity of the LED are adjustable.

According to NL1009242 the illumination device may be used in bedrooms to automatically provide a user who leaves the bed with light during the night. The motion detector detects movements and automatically switches on the light, in case the light intensity of the surrounding area is below a predetermined threshold.

The intensity of the light generated by the illumination device can be set by the user using a current setting button, corresponding to a wheel button, to adjust the current supplied to the light source.

There are several problems associated with such known illumination devices, such as:

not all motions should result in switching on the illumination device, such as for instance sleep movements, it may be difficult for a user to operate the illumination device, such as controlling the intensity of the light, as the control buttons may be in the dark, even when the illumination device is switched on.

SHORT DESCRIPTION

It is an object of the invention to provide an emergency illumination device that at least solves one of the above identified problems, thereby providing an emergency illumination device that is more user-friendly.

According to an aspect there is provided an emergency illumination device comprising a housing, the emergency illumination device being arranged to comprise a light source and a power supply, the emergency illumination device further comprising a motion detector to generate a motion signal when motion is detected, the emergency illumination device is arranged to switch on the light source when a motion signal is generated by the motion detector, characterized in that the housing comprises a first outer surface arranged to support the emergency illumination device when positioned on a bearing surface, and the motion detector generates a motion detection plane that is substantially perpendicular with respect to the first outer surface.

According to a further aspect there is provided a method for operating an emergency illumination device, the method comprising:

a) generating a motion detection plane, b) switching on a light source in response to a motion signal representing a detection of motion in the motion detection plane, c) controlling a light intensity of the light source in response to a tilt signal, representing tilt of the emergency illumination device.

According to a further aspect there is provided a computer program, when loaded on a computer, provides the computer with the functionality to perform the above method.

According to a further aspect there is provided a computer readable medium, comprising such a computer program.

SHORT DESCRIPTION OF THE DRAWINGS

Figure 1B:
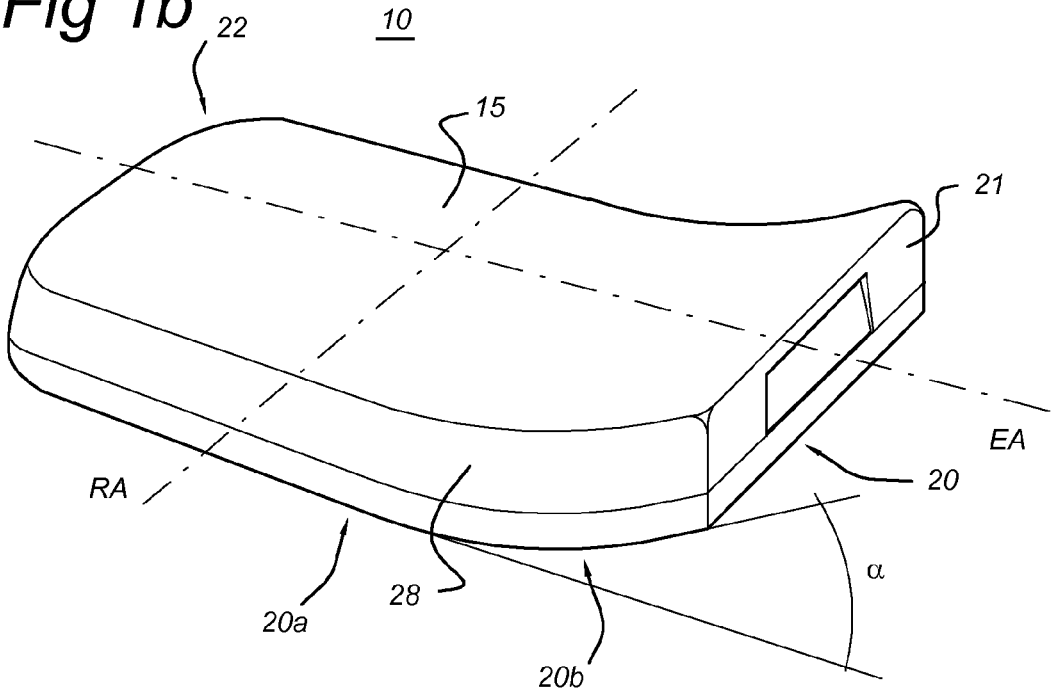
Figure 2A:
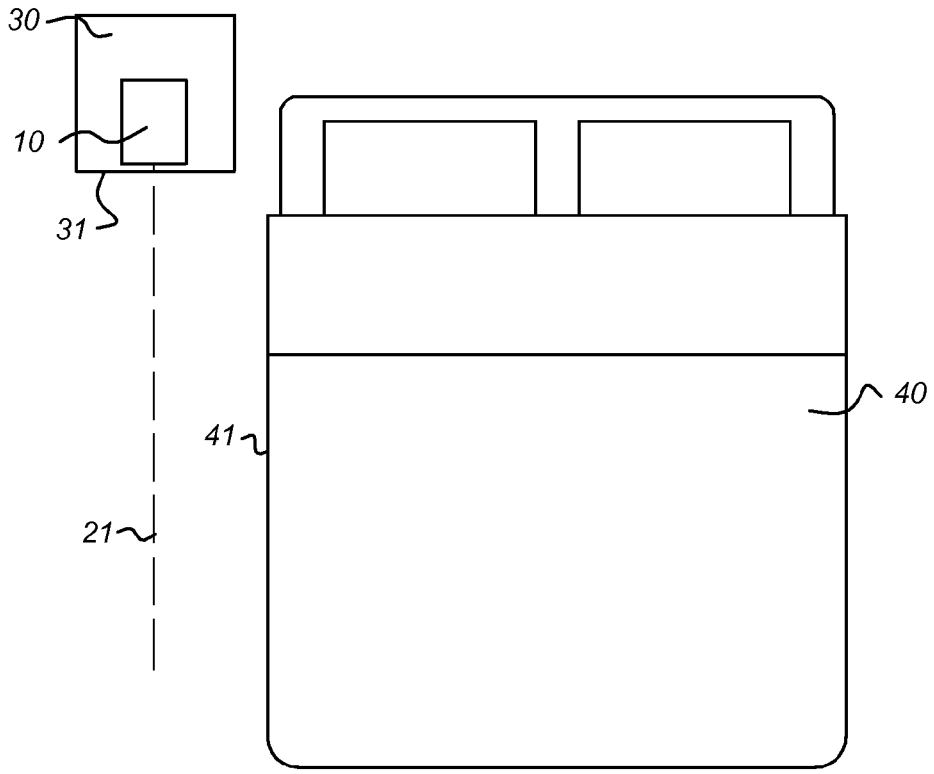
Figure 2B:
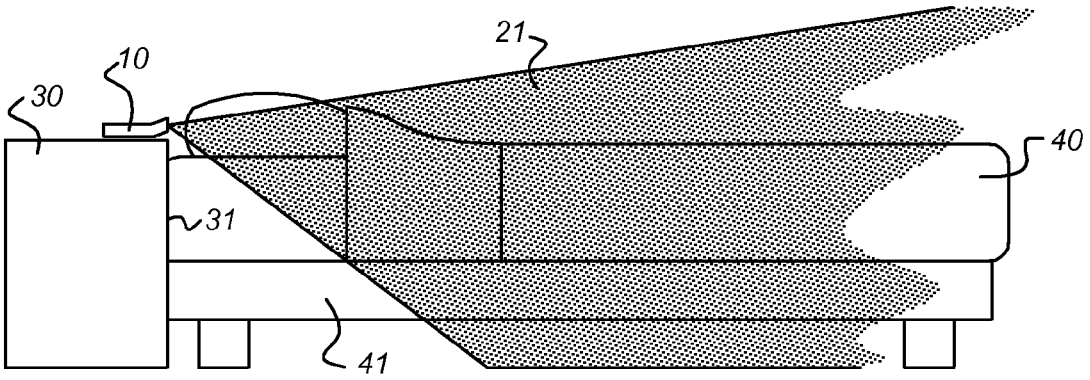
Figure 3A:
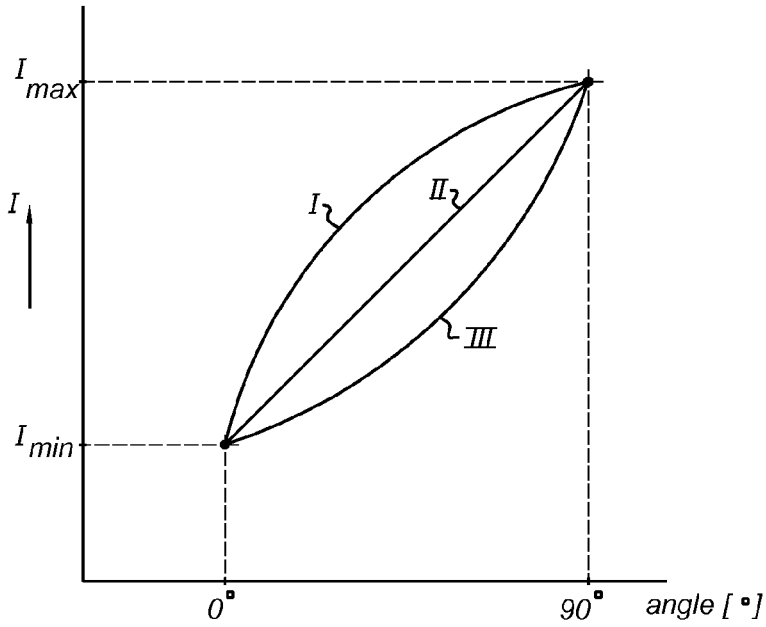
Figure 3B:
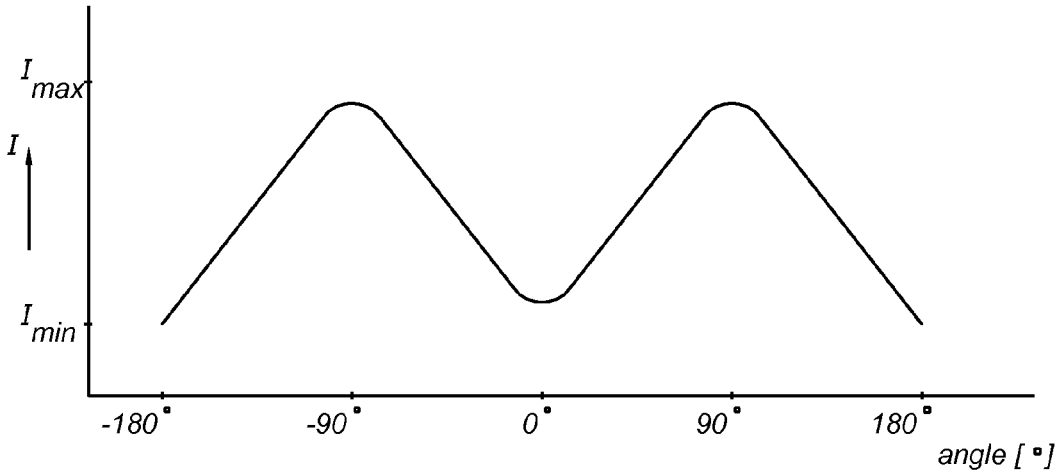
Figure 4:
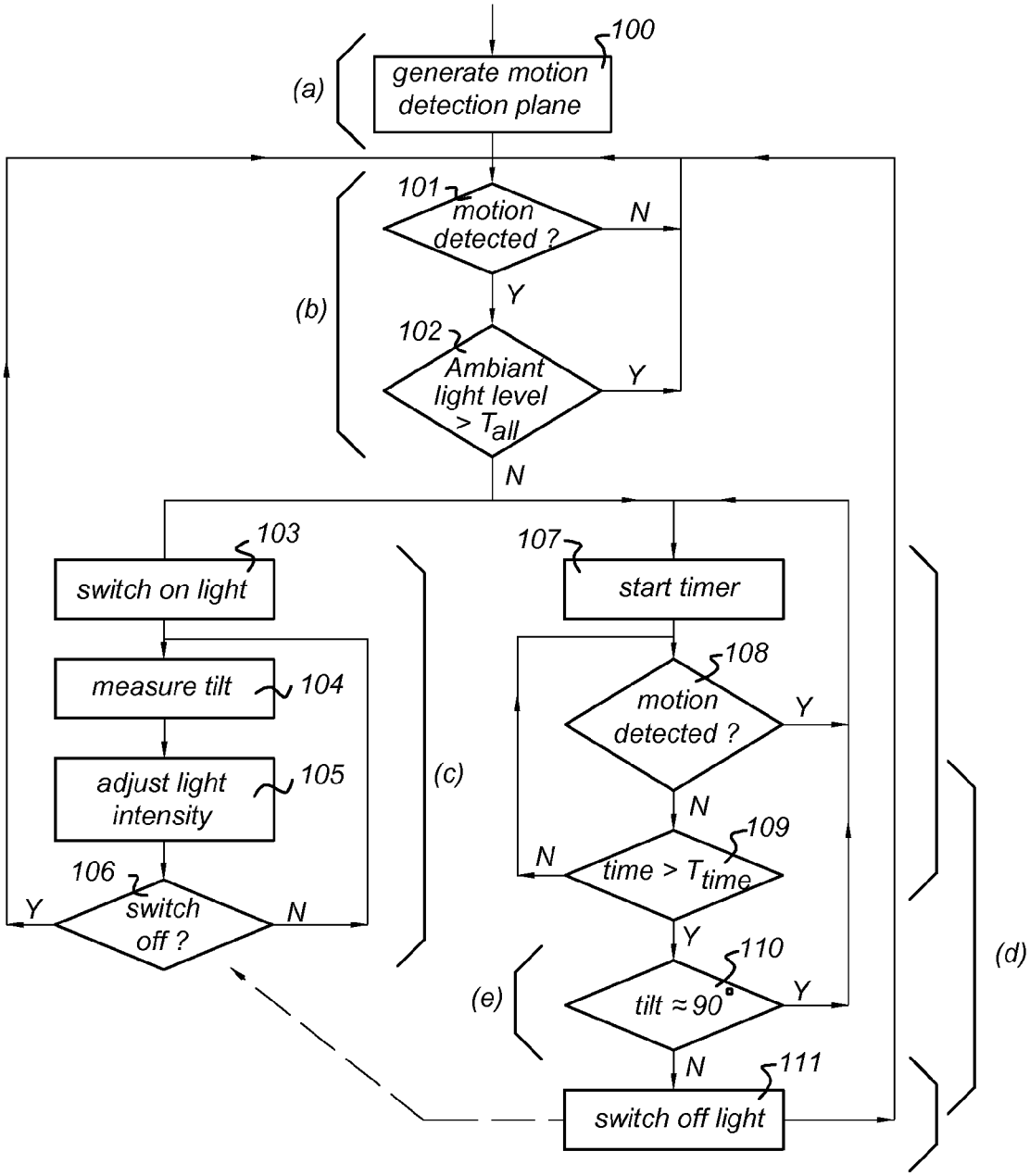

Embodiments will now be described, by way of example only, with reference to the accompanying schematic drawings in which corresponding reference symbols indicate corresponding parts, and in which:

FIGS. 1*a* and 1*b* schematically depict an emergency illumination device according to an embodiment, FIGS. 2*a* and 2*b* schematically depict an emergency illumination device positioned in a bed room, FIGS. 3*a* and 3*b* schematically depict a predetermined relation between a measured tilt and a light intensity, FIG. 4 schematically depicts a flow diagram according to an embodiment.

DETAILED DESCRIPTION

According to the embodiments, there is provided an emergency illumination device 10 that can be positioned next to a bed in such a way that it only switches on when a user leaves the bed.

FIGS. 1*a* and 1*b* schematically show an emergency illumination device 10 according to an embodiment. FIG. 1*a* shows the emergency illumination device 10 in a functional way, showing the basic elements that may be provided inside the emergency illumination device. FIG. 1*b* schematically shows a perspective view of such an emergency illumination device 10.

According to an embodiment there is provided an emergency illumination device 10 comprising a housing 15, the emergency illumination device 10 being arranged to comprise a light source 11 and a power supply 14, the emergency illumination device 10 further comprising a motion detector 12 to generate a motion signal when motion is detected, the emergency illumination device 10 is arranged to switch on the light source 11 when a motion signal is generated by the motion detector 12, wherein the housing 15 comprises a first outer surface 20 arranged to support the emergency illumination device 10 when positioned on a bearing surface, and the motion detector 12 generates a motion detection plane that is substantially perpendicular with respect to the first outer surface 20.

The housing 15 may be a substantially closed housing, for instance made of plastic or any other suitable type of material.

The housing may comprise openings, such as transparent openings for emitting light from the light source 11 and allowing the motion detector to detect motion. The housing 15 may further be arranged to allow a light detector (described below) to detect an ambient light level.

The motion detector 12 may be any kind of suitable motion detector, such as an infrared detector, or other suitable motion detector. The first outer surface 20 may be shaped such to allow stable positioning of the emergency illumination device 10 on the bearing surface. The bearing surface may for instance be a table or a bedside table.

The light source may for instance be a LED light source, or any other suitable type of light source.

The emergency illumination device may further comprise a control unit 13 to provide the emergency illumination device 10 with the functionality as described in the embodiments. The control unit 13 may for instance be a computer arrangement, comprising a processor and a memory, the memory comprising programming lines that are readable and executable by the processor to provide the emergency illumination device 10 with the functionality as described in the embodiments. Alternatively, the control unit 13 may also be formed as a hardware tool embedding the functionality as described in the embodiments.

The power supply 14 may be any kind of power supply, such as for instance a rechargeable battery. The power supply 14 may be arranged to supply all components of the emergency illumination device 10, such as the light source 11, the motion detector 12, the control unit 13, etc. with power.

FIGS. 2*a* and 2*b* schematically depict a way to use the emergency illumination device 10. FIG. 2*a* shows a top view and FIG. 2*b* shows a perspective view. FIGS. 2*a* and 2*b* schematically depict a bed table 30 and a bed 40 in a usual mutual orientation, wherein an edge 31 of the bed table 30 is substantially perpendicular to an edge 41 of the bed 40 (the edge 41 being substantially in the direction of a person sleeping in the bed 40).

The emergency illumination device 10 is positioned on the bed table 30 with the first outer surface 20, i.e. the first outer surface 20 supports the emergency illumination device 10 when positioned on the bearing surface formed by the bed table 30.

Also shown in FIGS. 2*a* and 2*b* is that the motion detector 12 generates a motion detection plane 21 that is substantially perpendicular with respect to the first outer surface 20.

This allows a user to position the emergency illumination device 10 in such a way that the motion detection plane 21 is substantially parallel to the edge 41 of the bed 40, such that the motion detector 12 only detects motion to trigger switching on the light source 11 when a user leaves the bed 40. Thereby it is prevented that sleeping movements will be detected by the motion detector 12.

According to a further embodiment there is provided an emergency illumination device 10 wherein the emergency illumination device 10 further comprises a light detector 16 to detect an ambient light level, and the emergency illumination device 10 is arranged to switch on the light source 11 when a motion signal is generated by the motion detector 12 only when the ambient light level is below a predetermined threshold. This prevents the emergency illumination device 10 from being switched on in situations in which enough ambient light is available, thereby saving energy. The light detector 16 is also schematically shown in FIG. 1*a*.

Although not shown, the illumination device 10 may further comprise a battery indicator, providing an indication of the status of the battery. The battery indicator may for instance be a green light that provides a battery status code upon switching on (for instance when switched on upon detection of a movement). The battery status code may be provided by blinking.

According to a further embodiment, the housing 15 has an elongated shape, wherein the elongated shape and the motion detection plane are substantially in line.

The elongated shape of the emergency illumination device 10 may be defined by an elongated axis EA. The elongated axis EA is depicted in FIGS. 1*a* and 1*b* and is in the direction the emergency illumination device 10 is longest.

This ensures that a user will intuitively position the emergency illumination device 10 correctly, allowing intuitively directing the motion detecting plane 21 in a desired direction, for instance parallel to the edge 41 of the bed 40 as in FIGS. 2*a* and 2*b*.

For instance, the user will intuitively position the emergency illumination device 10 with the elongated axis AE substantially perpendicular to the edge 31 of the bed table 30, such that the motion detection plane is substantially parallel with respect to the edge 41 of the bed 40.

The motion detector 12 is positioned inside the housing 15 in such a way that the motion detection plane can be generated via a second side, forming a front outer surface 21 of the housing.

According to a further embodiment the housing 15 comprises a front outer surface 21 providing an window (which may also be referred to as an exit window) for the motion detection plane 21, wherein the first outer surface 20 is provided with a bend 28 in the vicinity of the front outer surface, such that a normal of the front outer surface is at an angle $\alpha>0°$ with respect to the first surface, The bend 28 may provide the first outer surface 20 with an angle of approximately 10°-45°.

As a result, the first outer surface 20 may comprise a first part 20*a* arranged to be in contact with the bearing surface, and a second part 20*b* at an angle with respect to the first part 20*a*, arranged to be clear from the bearing surface. The bend 28 may be gradual. Also the second part 20*a* may not be completely straight.

In order to allow stable positioning, the first part 20*a* may be larger than the second part 20*b*.

The second part 20*b* of the first outer surface 20 may be clear from the bearing surface when the emergency illumination device 10 is positioned on the bearing surface. At least part of the second part 20*b* may be transparent to form a light emission window. The light source 11 may be positioned in the vicinity of this light emission window. The fact that the second part 20*b* is clear from the bearing surface allows light to be emitted from the light emission window to illuminate part of the environment. This design provides an aesthetic effect. This design also ensures that when first switched on in response to detected movement, the emergency illumination device 10 does not spread light through the entire room, but light is only spread in a downward direction to a relevant part of the room. Bend 28 in combination with the fact that the second part 20*b* is smaller than the first part 20*a*, allows intuitive positioning of the emergency illumination device 10. The bend 28 prevents users from positioning the emergency illumination device 10 in an upside-down orientation.

According to a further embodiment there is provided an emergency illumination device 10 comprising at least one tilt sensor 17 generating a tilt signal, wherein the emergency illumination device 10 is arranged to control a light intensity of the light source 11, the light intensity being in a predetermined relation to the tilt signal. The control of the light intensity may be performed by a continuous control loop.

The predetermined relation between the light intensity and the tilt signal may define that when the emergency illumination device 10 is in an upright position, the light intensity may be at a maximum.

The tilt sensor 17 may be arranged to measure tilt about a rotation axis RA that is substantially perpendicular to the elongated axis AE and substantially parallel to the first outer surface 20.

FIG. 3*a* schematically depicts examples of such a predetermined relation between the measured tilt signal (representing an angle) and the light intensity I of the light source 11. FIG. 3 depicts the predetermined relation as a mathematical function or the like, but other ways of defining the predetermined relation may be conceived, such as for instance by using a table.

The vertical axis shows the light intensity I, but can of course also represent some kind of other parameter that can be used to control the light intensity, such as for instance a current or voltage.

According to an embodiment the tilt signal represents a first angle corresponding to a minimum light intensity, wherein the first angle corresponds to a substantially horizontal orientation of the first outer surface.

According to a further embodiment the tilt signal represents a second angle corresponding to a maximum light intensity, wherein the second angle corresponds to a substantially vertical orientation of the first outer surface.

As shown in FIG. 3*a*, the tilt signal may vary from a first angle of approximately 0°, corresponding to the situation in which the first outer surface 20 is substantially horizontal, to a second angle 90°, in which the first outer surface 20 is substantially vertical. As can be seen in FIG. 3*a*, the first angle may correspond to a minimum light intensity and the second angle may correspond to a maximum light intensity.

FIG. 3*a* depicts three possible predetermined relations between the tilt and the light intensity: a concave function I, a straight function II and a convex function III. However, it will be understood that many alternative relations are conceivable.

As shown in FIG. 3*b*, appropriate values may be defined for angles outside the shown range. For instance, when the emergency illumination device 10 is rotated to angle above 90°, the intensity may reduce to a minimum at an angle of 180°. Also, for angles below 0°, the intensity may increase to a maximum value at an angle of −90°.

This embodiment allows an easy control of the emergency illumination device 10 for a user. There is no need for a user to search for a control button or the like to control the intensity of the generated light, which are usually difficult to find and use in weak light conditions. According to this embodiment, the emergency illumination device 10 is the control button.

It may also be difficult to switch off the emergency illumination device 10 in circumstances without enough ambient light. This may be overcome by an embodiment in which the emergency illumination device 10 is arranged to perform a time out function.

According to such an embodiment, the emergency illumination device further comprises a timer 18 arranged to generate a time out signal after a predetermined time out interval from switching on the light source 11 in response to the motion signal if there is no motion signal generated by the motion detector within the predetermined time out interval, wherein the emergency illumination device 10 is arranged to perform a time out function by switching off the light source in response to the time out signal.

Switching off the light source may be done by fading.

This allows an easy way of switching of the emergency illumination device 10. For instance, when a user returns to the bed 40, he/she just positions the emergency illumination device 10 on the bed table 30 (as shown in FIGS. 2*a* and 2*b*) and goes to sleep. The timer 18 will generate a time out signal if no movement has been detected during a predetermined time out interval and emergency illumination device 10 will automatically switch itself off in response to the time out signal.

The predetermined time out interval may for instance be 12 seconds or 1 minute.

However, this embodiment may have the problem that in some situation a user may want to position the emergency illumination device 10 somewhere, but does not want it to be switched off. For instance in case a user may need to perform certain actions in which two hands are needed, such as getting dressed for evacuation, the emergency illumination device 10 is not supposed to automatically switch itself off after a predetermined time out interval in which no motion is detected. It is to be noted that the user may perform actions which may not involve enough motion to be detected by the emergency illumination device 10. Also, the emergency illumination device 10 may be positioned such that the motions are not in the motion detection plane 21.

Therefore, according to an embodiment, the time out function is disabled as long as the tilt sensor generates a tilt signal representing the second angle, the second angle corresponding to a substantially vertical orientation of the first outer surface (i.e. approximately 90°).

This allows an easy way for a user to overrule the timer function and thereby preventing automatic switch off of the light after a predetermined time out interval wherein no motion is detected. This may for instance be useful when a user wants to use the emergency illumination device 10 as semi-permanent illumination device, for instance when performing actions requiring two hands. By simply positioning the emergency illumination device 10 on the second outer surface, the time out function can be overruled or disabled, thereby preventing automatic switch off.

In situations in which the user want to overrule the time out function, it is often desirable for the user to put down the emergency illumination device 10 somewhere, for instance when the user wants to get dressed for evacuation.

According to an embodiment, the housing 15 of the emergency illumination device 10 comprises a second outer surface 22 arranged to support the emergency illumination device 10 in an orientation substantially corresponding to the second angle.

This allows a user to temporarily put down the emergency illumination device 10 on the second surface 22 without the emergency illumination device 10 being switched off automatically. Again, this may be useful when a user wants to use the emergency illumination device 10 as a semi-permanent lamp. By simply positioning the emergency illumination device 10 on the second outer surface 22, automatic switch off is prevented.

Although not mentioned explicitly throughout the description, it will be understood that all functionality may be performed by the control unit 13. The control unit 13 may be arranged to communicate with all the relevant elements in the emergency illumination device 10, such as with

- the light source 11, e.g. by sending a control signal to switch the light source 11 on or off, the motion detector 12, e.g. by sending a control signal to switch the motion detector 12 on or off and by receiving a motion detection signal from the motion detector, the light detector 16, e.g. by sending a control signal to switch the light detector 16 on or off and by receiving a light detection signal from the light detector 16, the tilt sensor 17, e.g. by sending a control signal to switch the tilt sensor 17 on or off and by receiving a tilt signal from the tilt sensor 17, the timer 18, e.g. by sending a control signal to trigger and/or reset the timer 18 and by receiving a time out signal from the time 18.

Alternatively, the functionality is embedded in the circuitry, without using a separate control unit 13.

The emergency illumination device 10, possibly by means of a control unit 13, may be arranged to perform functionality as schematically shown in FIG. 4. It is noted that FIG. 4 is just an example and that many other ways of implementing the embodiments may be conceived.

In a first action 100, a motion detection plane is generated using the motion detector 12. The motion detection plane is generated substantially perpendicular to the bearing surface.

In a next action 101, a motion detection signal is awaited from the motion detector 12. Once a motion detection signal is generated, in action 102 it is decided if the ambient light level measured by the light sensor 17 is below a predetermined threshold value $T_{ALL}$. If not, action 101 is repeated; if so, actions 103 and 107 are performed.

In action 103 the light source 11 is switch on. Next, in action 104 tilt is measured using the tilt sensor 17 and in action 105 the light intensity is adjusted in response to the measured tilt signal. Next, in action 106 it is verified if a switch off signal is received. If not, actions 103, 104, 105 are repeated.

In action 107 the timer 18 is triggered to start timing. Next, in action 108 it is checked if any motion is detected. If so, action 107 is repeated thereby re-starting the timer 18. If not, in action 109 it is verified if the time as counted by the timer 18 exceeds a predetermined time out interval. If not, actions 108 and 109 are repeated. If so, in action 110 it is determined if the tilt signal as generated by the tilt sensor 17 is substantially equal to the second angle. If so, actions 107, 108, 109 and 110 are repeated. If not, a switch off signal is generated to switch off the light source 11. The switch off signal is used as input in action 106, if present.

According to a further embodiment, the light source is arranged to provide red light.

It is found that red light has certain advantages in emergency situations, such as in a fire or in smoky conditions. It is discovered that red light provides the best visibility for a user in smoky conditions, in particular in situations with organic smoke. The red light easily penetrates through the smoke instead of being reflected by the smoke to blind a user.

The colour red may be defined by its wavelength, which may be in the range from 640 nm-700 nm.

Describing FIG. 4 in a more general way, provides a method for operating an emergency illumination device 10, wherein the emergency illumination device 10 comprises a housing, the housing of the emergency illumination device 10 comprising a first outer surface arranged to support the emergency illumination device 10 when positioned on a bearing surface, the method comprising:

a) generating a motion detection plane that is substantially perpendicular with respect to the first outer surface, b) switching on a light source in response to a motion signal representing a detection of motion in the motion detection plane.

According to a further embodiment, the method comprises c) controlling a light intensity of the light source in response to a tilt signal, representing tilt of the emergency illumination device 10.

Action a) corresponds to action 100, action b) corresponds to actions 101 and 102, action c) corresponds to actions 103, 104, 105, 106.

According to a further embodiment, the method further comprises:

d) performing a time out function comprising switching off the light source after a predetermined time out interval in which no motion has been detected.

Action d) corresponds to actions 107, 108, 109, 111.

According to a further embodiment, the method further comprises:

e) disabling the time out function in case the measured tilt signal represents a second angle, the second angle corresponding to a substantially vertical orientation of a first outer surface.

Action e) corresponds to action 110.

As described above, the emergency illumination device 10 may be provided with the functionality according to the embodiments by a computer program. There may be provided a computer program, when loaded on a computer, provides the computer with the functionality to perform any one of the methods according to the embodiments. Further provided is a computer readable medium, comprising such a computer program.

It is further emphasized that the illumination device as described above may also be used as in non-emergency situations. The illumination device may be used to help a user find its way to the bathroom during the night.

The described design and the location of the illumination source ensures that when first switched on in response to detected movement, the emergency illumination device 10 does not spread light through the entire room, thereby preventing waking up other people.

Also, the possibility to disable the time out function when the tilt sensor generates a tilt signal representing the second angle, the second angle corresponding to a substantially vertical orientation of the first outer surface (i.e. approximately 90°), allows to use the illumination device as semi-permanent illumination device, for instance when the users wants to read a book in bed.

The descriptions above are intended to be illustrative, not limiting. Thus, it will be apparent to one skilled in the art that modifications may be made to the invention as described without departing from the scope of the claims set out below.

The invention claimed is:

1. Emergency illumination device comprising a housing, the emergency illumination device being arranged to comprise a light source and a power supply, the emergency illumination device further comprising a motion detector to generate a motion signal when motion is detected, the emergency illumination device is arranged to switch on the light source when a motion signal is generated by the motion detector, wherein the housing comprises a first outer surface arranged to support the emergency illumination device when positioned on a bearing surface, and the motion detector generates a motion detection plane that is substantially perpendicular with respect to the first outer surface characterized in that the emergency illumination device comprises at least one tilt sensor generating a tilt signal, wherein the emergency illumination device is arranged to control a light intensity of the light source, the light intensity being in a predetermined relation to the tilt signal.

2. Emergency illumination device according to claim 1, wherein the emergency illumination device further comprises a light detector to detect an ambient light level, and the emergency illumination device is arranged to switch on the light source when a motion signal is generated by the motion detector only when the ambient light level is below a predetermined threshold.

3. Emergency illumination device according to claim 2, wherein the housing has an elongated shape, wherein the elongated shape and the motion detection plane are substantially in line.

4. Emergency illumination device according to claim 2, wherein the housing comprises a front outer surface providing an window for the motion detection plane, wherein the first outer surface is provided with a bend 28 in the vicinity of the front outer surface, such that a normal of the front outer surface is at an angle $\alpha>0°$ with respect to the first surface.

5. Emergency illumination device according to claim 1, wherein the housing has an elongated shape, wherein the elongated shape and the motion detection plane are substantially in line.

6. Emergency illumination device according to claim 5, wherein the housing comprises a front outer surface providing an window for the motion detection plane, wherein the first outer surface is provided with a bend 28 in the vicinity of the front outer surface, such that a normal of the front outer surface is at an angle $\alpha>0°$ with respect to the first surface.

7. Emergency illumination device according to claim 1, wherein the housing comprises a front outer surface providing an window for the motion detection plane, wherein the first outer surface is provided with a bend 28 in the vicinity of the front outer surface, such that a normal of the front outer surface is at an angle $\alpha>0°$ with respect to the first surface.

8. Emergency illumination device according to claim 7, wherein the tilt signal represents a first angle corresponding to a minimum light intensity, wherein the first angle corresponds to a substantially horizontal orientation of the first outer surface.

9. Emergency illumination device according to claim 8, wherein the tilt signal represents a second angle corresponding to a maximum light intensity, wherein the second angle corresponds to a substantially vertical orientation of the first outer surface.

10. Emergency illumination device according to claim 8, wherein the emergency illumination device comprises a timer arranged to generate a time out signal after a predetermined time out interval from switching on the light source in response to the motion signal if there is no motion signal generated by the motion detector within the predetermined time out interval, wherein the emergency illumination device is arranged to perform a time out function by switching off the light source in response to the time out signal.

11. Emergency illumination device according to claim 7, wherein the tilt signal represents a second angle corresponding to a maximum light intensity, wherein the second angle corresponds to a substantially vertical orientation of the first outer surface.

12. Emergency illumination device according to claim 7, wherein the emergency illumination device comprises a timer arranged to generate a time out signal after a predetermined time out interval from switching on the light source in response to the motion signal if there is no motion signal generated by the motion detector within the predetermined time out interval, wherein the emergency illumination device is arranged to perform a time out function by switching off the light source in response to the time out signal.

13. Emergency illumination device according to claim 12, wherein the time out function is disabled as long as the tilt sensor generates a tilt signal representing the second angle, the second angle corresponding to a substantially vertical orientation of the first outer surface.

14. Emergency illumination device according to claim 13, wherein the housing of the emergency illumination device comprises a second outer surface arranged to support the emergency illumination device in an orientation substantially corresponding to the second angle.

15. Emergency illumination device according to claim 1, wherein the light source is arranged to provide red light.

16. Method for operating an emergency illumination device, wherein the emergency illumination device comprises a housing, the housing of the emergency illumination device comprising a first outer surface arranged to support the emergency illumination device when positioned on a bearing surface, the method comprising:

a) generating a motion detection plane that is substantially perpendicular with respect to the first outer surface, b) switching on a light source in response to a motion signal representing a detection of motion in the motion detection plane, c) controlling a light intensity of the light source in response to a tilt signal, representing tilt of the emergency illumination device.

17. Method according to claim 16, the method further comprising:

d) performing a time out function comprising switching off the light source after a predetermined time out interval in which no motion has been detected.

18. Method according to claim 17, the method further comprising:

e) disabling the time out function in case the measured tilt signal represents a second angle, the second angle corresponding to a substantially vertical orientation of a first outer surface.

19. A computer program product comprising a non-transitory computer readable medium having stored thereon computer executable instructions which when executed by a computer perform the method of claim 16.

* * * * *

UNITED STATES PATENT AND TRADEMARK OFFICE

CERTIFICATE OF CORRECTION

PATENT NO. : 8,567,993 B2
APPLICATION NO. : 13/132933
DATED : October 29, 2013
INVENTOR(S) : Michael Robert ten Wolde It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 330 days.

Signed and Sealed this
Fifteenth Day of September, 2015

Michelle K. Lee

Michelle K. Lee
*Director of the United States Patent and Trademark Office*